United States Patent [19]

Magnuson

[11] 4,183,180

[45] Jan. 15, 1980

[54] INSTRUMENT AND TOOL HONING MECHANISM

[76] Inventor: Victor E. Magnuson, 1818 Linden Ave., Mishawaka, Ind. 46544

[21] Appl. No.: 882,776

[22] Filed: Mar. 2, 1978

[51] Int. Cl.[2] ..... B24B 19/00

[52] U.S. Cl. ..... 51/58

[58] Field of Search ..... 51/57, 58, 99, 68, 69, 51/47, 59 R

[56] References Cited

U.S. PATENT DOCUMENTS

| | | | |
|---|---|---|---|
| 1,389,835 | 9/1921 | Lecomte | 51/99 X |
| 2,450,237 | 9/1948 | Indge | 51/58 |
| 3,369,329 | 2/1968 | Beiman | 51/58 X |
| 3,576,089 | 4/1971 | Magnuson | 51/59 R |
| 3,958,371 | 5/1976 | Redko et al. | 51/58 |

*Primary Examiner*—Harold D. Whitehead
*Attorney, Agent, or Firm*—Marmaduke A. Hobbs

[57] ABSTRACT

An instrument and tool honing mechanism in which a gear rack is mounted on and movable with a reciprocable bar, and a spindle having a pinion thereon is supported by a fixture in a transverse relationship to said bar with the pinion in engagement with the gear rack. A honing element is mounted on the spindle, and when the bar reciprocates, the rack creates a reciprocating movement in the spindle, and hence rotates the honing element on the spindle. The mechanism is preferably constructed as an attachment for a honing machine, and is capable of being readily mounted on and removed from the machine. The fixture preferably is pivoted to the rear of the reciprocable bar for angular movement from a position substantially horizontal to an elevated position where the pinion is disengaged from the gear rack. The honing element may be spherical or cylindrical shaped, and is normally mounted on a forwardly projecting end of the spindle where it can easily be used to recondition instruments and tools of the type normally used by dentists and doctors.

6 Claims, 6 Drawing Figures

Fig. 3
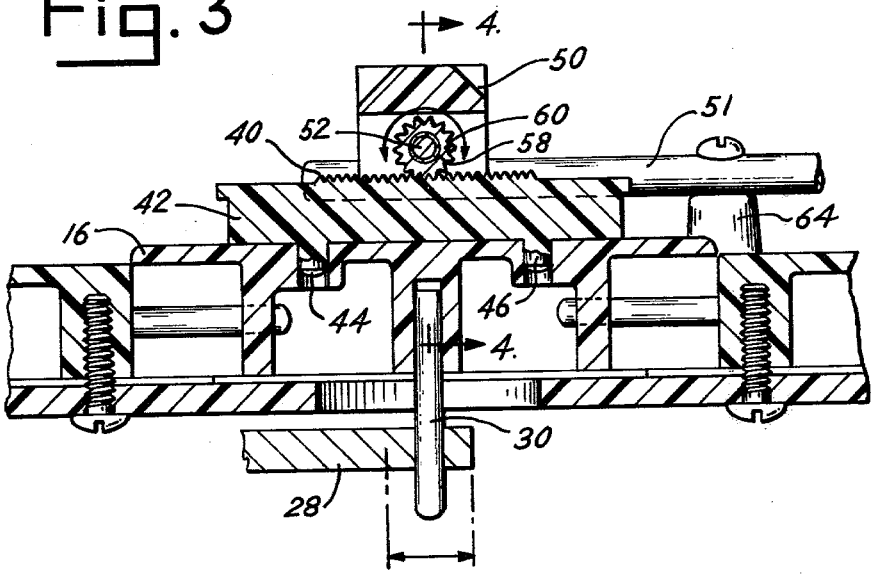
Fig. 4
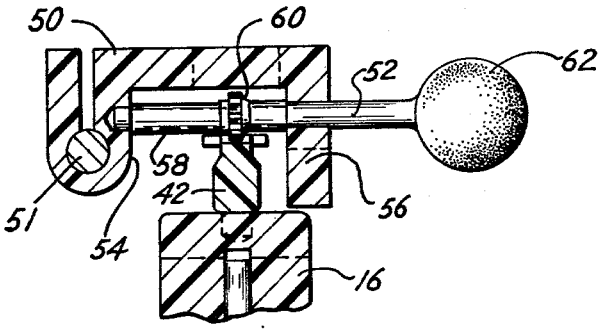
Fig. 5
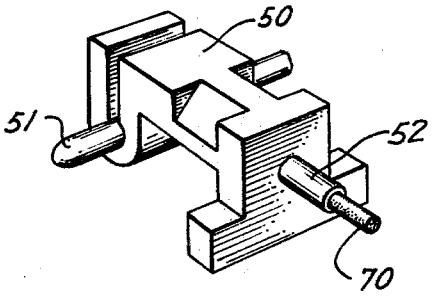
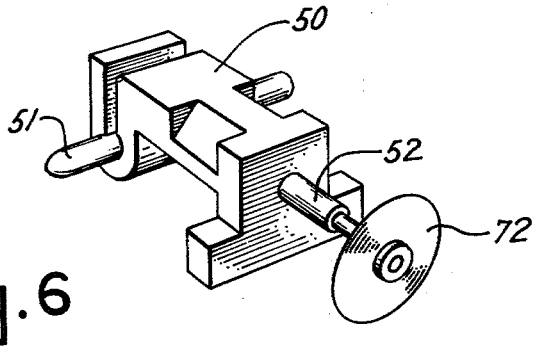
Fig. 6

INSTRUMENT AND TOOL HONING MECHANISM

The instruments and tools used by dentists and surgeons have specialized tips which must often be sharp in order to be effectively used to perform the various operations and procedures on the patients. At one time the practice used by the dentists and surgeons was to use the instruments and tools until they became dull and then to discard them for new instruments and tools. This practice was expensive, and often encouraged the dentist and surgeon to use less than sharp, if not dull, instruments and tools. In order to eliminate this high risk in operations and procedures, a honing machine was invented and developed so that the instruments and tools could conveniently be sharpened and honed by dentists and surgeons, or by their assistants, so that the instruments and tools could be maintained in optimum condition for performing the operations or procedures for which they were initially intended. This machine, which is covered by my U.S. Pat. No. 3,576,089 issued on Apr. 27, 1971, will perform a number of different honing, sharpening and reconditioning operations on various instruments and tools, using straight, rapidly reciprocating hones, usually of vitrified aluminum oxide, alumina ceramic, natural stone, or diamond-plated hones. While the straight reciprocating hones of the type disclosed in the aforementioned patent will perform most operations commonly required for sharpening and honing the instruments and tools used most often by dentists and surgeons, there are some instruments and tools which cannot effectively be sharpened and honed by that type of hone. For example, dished or spoon-shaped instruments requiring sharp peripheral edges could previously only be sharpened on the external side. This sometimes results in a fine ragged edge, and often a somewhat misshapen instrument or tool configuration. It is therefore one of the principal objects of the present invention to provide a honing machine for instruments and tools used by dentists and surgeons, which provides, in addition to the reciprocating type of hone, other types of hones, such as ball and cylindrical hones, which can be operated effectively and efficiently by the same drive mechanism as the one which drives the straight reciprocating hones, and which can easily and readily be interchanged with any one of the other types without dismantling the machine.

Another object of the invention is to provide a device for mounting on and being driven by the type of honing machine disclosed in my aforementioned patent, which has a rotary honing action for use in sharpening and honing instruments, tools and the like, and which can easily be attached to and removed from the machine.

Still another object of the invention is to provide a mechanism for honing, sharpening and performing other reconditioning operations on small instruments and tools, such as those used by dentists, which performs those operations by small and rapid rotary reciprocating movement, and which is so constructed and designed that delicate and precise sharpening and honing operations can easily be performed on the instruments and tools.

A further object is to provide an attachment for a honing machine having a straight reciprocating bar, which operates a hone in a rotary reciprocating movement, and which is simple in construction and operation and can readily be assembled on and removed from the machine.

Another object is to provide a relatively simple and dependable honing and sharpening machine for dentist's tools and similar instruments, which can conveniently be used in an office or laboratory without any special installation or service, and which can readily be moved from place to place and easily stored when not in use.

Additional objects and advantages of the present invention will become apparent from the following description and accompanying drawings, wherein:

FIG. 3 is a vertical cross sectional view of the honing mechanism shown in the preceding figures, the section being taken on line 3—3 of FIG. 2;

FIG. 4 is a vertical cross sectional view of the honing mechanism as shown in FIG. 3, the section being taken on line 4—4 of FIG. 3, and illustrating one form of a honing element;

FIG. 5 is a perspective view of the fixture forming a part of the honing mechanism shown in the preceding figures, illustrating another form of the honing element; and FIG. 6 is a perspective view similar to that shown in FIG. 5 with a different honing element illustrated.

Figure 1:
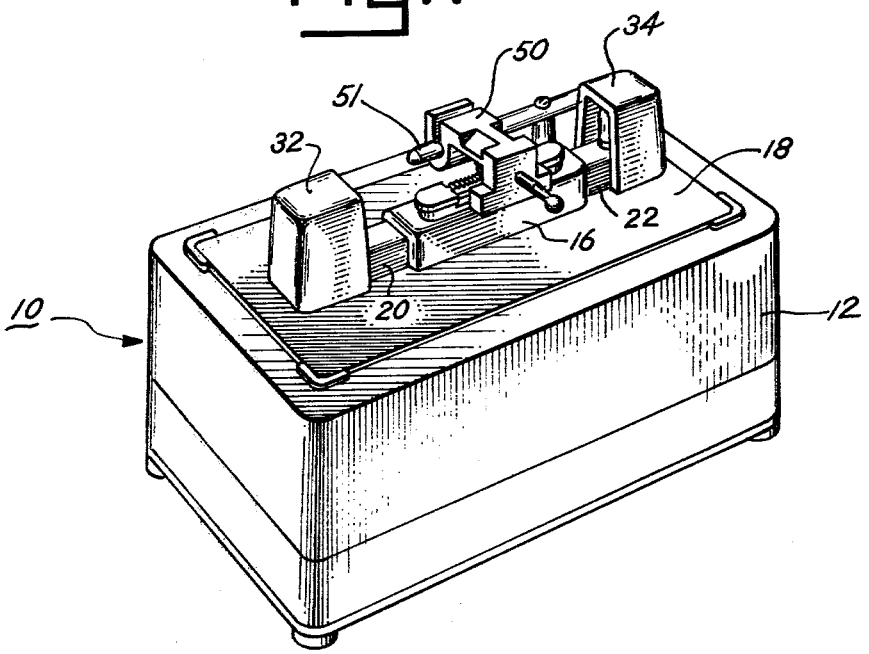
FIG. 1 is a perspective view of a honing machine with the present instrument and tool honing mechanism mounted thereon.

Referring more specifically to the drawings, numeral 10 indicates generally a honing machine of the type illustrated in my U.S. Pat. No. 3,576,089, including a housing 12 which contains a motor seen in FIG. 2 at numeral 14, which operates a reciprocating bar 16 mounted on the top plate 18 of housing 12. The bar is supported at each end as shown at numerals 20 and 22 and, as used in the manner illustrated in the patent, a hone or stone is supported by bar 16 which is reciprocated rapidly by motor 14 through crank 24, pin 26, arm 28 and pin 30, the latter pin being connected to the underside of bar 16.

When the motor is energized, the linkage, including crank 24 and arm 28, causes the bar to reciprocate in a straight horizontal movement. The honing machine thus far described has been used extensively for honing and sharpening instruments and tools used by dentists and doctors. Different types of straight stones and hones are used interchangeably on the bar to provide the type of honing operation required. However, the straight reciprocating hone is not suitable for performing a number of operations, particularly those in which there is a dished or spoon-shaped configuration, and can only partially and effectively sharpen and hone such types of instruments and tools. In order to facilitate effective observation of the sharpening and honing action, light assemblies 32 and 34 are preferably included at the ends of bar 16. While the present instrument and tool honing mechanism is primarily intended for use in conjunction with the type of machine illustrated in the patent, it can be adapted to other types of sharpening and honing machines having a reciprocating bar or the like. Further, while the present mechanism and the machine on which it is used are capable of performing a number of different types of sharpening and honing operations, for convenience of description in the specification and claims, the machine and operations performed thereby will be referred to as a "honing" machine and "honing" operations, respectively, and this term is intended to include both honing, sharpening and other similar operations.

The instrument and tool honing mechanism illustrated in the drawings includes a gear rack 40 mounted on or formed integrally with a base 42 which is removably secured to bar 16 by pins 44 and 46 extending downwardly into holes in the bar, holding the base firmly in place on the bar as the bar reciprocates. A fixture 50 is pivotally connected to shaft 51 and has a generally U-shaped configuration extending over the rack. A spindle 52 is journaled in rear wall 54 and front wall 56 of the fixture and is held therein by a sleeve 58 mounted on the spindle and held firmly in place by crimping or brazing or by any other suitable securing means. A gear or pinion 60 is mounted rigidly on and secured to sleeve 58 and engages the teeth of rack 40 for rotating spindle 52 as the rack reciprocates, rotating the honing element 62 in a reciprocating movement, as indicated by the arrows in FIG. 2.

Figure 2:
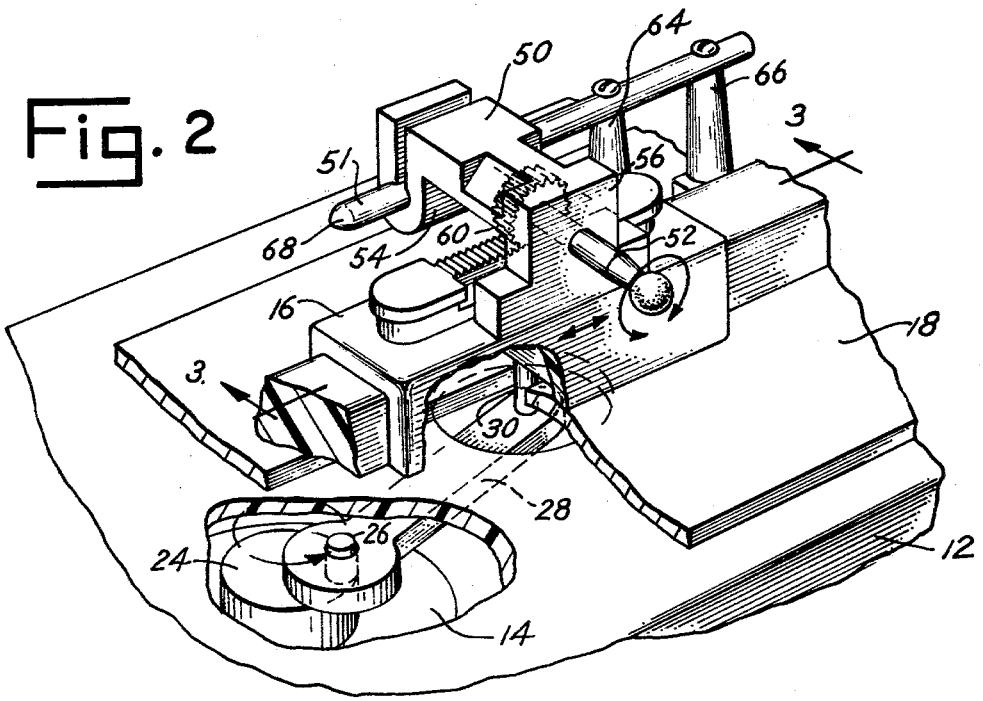
FIG. 2 is an enlarged, fragmentary perspective view of the honing mechanism seen in FIG. 1.

Fixture 50 can be pivoted angularly upwardly from the bar, thereby disengaging the pinion from the rack and permitting replacement of the rack 40 and base 42 by a straight hone or stone for normal honing operations, as described in the aforementioned patent. The fixture can easily be removed from the machine by slipping it to the left, as seen in FIGS. 1, 2 and 3, from the end of shaft 51. The shaft is rigidly supported on the machine by bosses 64 and 66, and has a free end 68 which permits the fixture to be readily assembled on and removed from the shaft. Normally only a snug fit of the fixture on shaft 51 is required to properly hold the fixture in operating position, with the pinion meshing with the gear rack. It is thus seen that the fixture can be raised angularly upwardly to permit the machine to be used with a straight honing element, and the fixture may be completely removed from the machine and replaced by a tool rest if desired, although the fixture can serve effectively as a tool rest provided the stone or hone does not engage the pinion.

Three different types of sharpening or honing elements are illustrated in FIGS. 4, 5 and 6, FIG. 4 illustrating a spherical shaped element 62, FIG. 5 illustrating a cylindrical shaped element 70, and FIG. 6 illustrating a disc shaped element 72. The fixture 50 has the same construction and design as that previously described herein, regardless of the type of honing or sharpening element used. For convenience, the entire fixture, including shaft 51, pinion 60, and the desired head, i.e. spherical, cylindrical or disc shaped element, is used as a unit and is assembled and disassembled on the machine as a unit, thus permitting the operations to be readily changed from one type to the other with a minimum amount of downtime.

In the operation of the present instrument and tool honing mechanism, the motor 14 is energized, thus causing bar 16 and rack 40 to rapidly reciprocate. With the reciprocation of gear rack 40 and with fixture 50 is in its horizontal position as illustrated in the drawings, the pinion is rapidly rotated in a reciprocating movement, thereby rapidly rotating one of the elements 62, 70 or 72. As the elements rotate, the technician using the machine can easily and effectively hold the instrument or tool in the position required to obtain the desired honing action. The spherical shaped element 62 permits effective honing of dished or spoon shaped instruments, and a variety of different types of operations can be performed with the cylindrical and disc shaped elements 70 and 72. When the honing operations involving tools 62, 70 and 72 are no longer required, the fixture can be raised angularly upwardly and will normally be removed from the machine by sliding it off the free end of shaft 51. This permits the machine to be used in a normal manner after the gear rack has been replaced with a straight hone or stone. A tool rest similar to fixture 50 can then be mounted on the machine, using shaft 51 as the primary support therefor.

It is seen that the present honing mechanism is readily adaptable to a honing machine as an attachment, and the mechanism can be used as a permanent part of the machine in place of the reciprocating stone if desired. However, the versatility of the machine is substantially enhanced by the interchangeability of the various honing elements, including the three rotating honing elements and straight reciprocating honing elements.

While only one embodiment of the present instrument and tool honing mechanism has been described in detail herein, various changes and modifications may be made without departing from the scope of the invention.

I claim:

1. An instrument and tool honing mechanism for use with a machine having an elongated reciprocably moving bar, comprising a gear rack for mounting on and moving with said reciprocable bar, a spindle movable between an operable position and an inoperable position, a fixture for rotatably mounting said spindle in a position transverse to said bar in close proximity thereto, a honing element mounted on said spindle for rotation therewith, a gear mounted on said spindle for meshing with said gear rack to drive said spindle and said honing element in a reciprocating rotary motion and being movable between an operable position meshing with said rack and an inoperable position disengaged from said rack, and a pivoted member attached to said fixture and adapted to be connected to a supporting structure for moving said fixture and spindle angularly toward and away from said rack for engaging and disengaging said gear and rack.

2. An instrument and tool honing mechanism as defined in claim 1 in which means releasably retains said gear rack on said reciprocable bar.

3. An instrument and tool honing mechanism as defined in claim 1 in which said fixture extends over said bar with the end of said spindle extending therefrom, and the honing element is mounted on said end.

4. An instrument and tool honing mechanism as defined in claim 2 in which said fixture extends forwardly over said bar with the end of said spindle extending forwardly therefrom, and the honing element is mounted on said end.

5. An instrument and tool honing mechanism as defined in claim 1, in which said fixture is of a generally U-shaped configuration and said shaft is journaled in the arms thereof and said gear is mounted on said shaft between said arms.

6. An instrument and tool honing mechanism as defined in claim 3, in which said fixture is of a generally U-shaped configuration and said shaft is journaled in the arms thereof and said gear is mounted on said shaft between said arms.

* * * * *